US011162660B2

(12) United States Patent
Lindholm

(10) Patent No.: US 11,162,660 B2
(45) Date of Patent: Nov. 2, 2021

(54) WORKING LIGHT

(71) Applicant: Nordic Lights Ltd., Jakobstad (FI)

(72) Inventor: Janne Lindholm, Pietarsaari (FI)

(73) Assignee: NORDIC LIGHTS LTD., Jakobstad (FI)

( * ) Notice: Subject to any disclaimer, the term of this patent is extended or adjusted under 35 U.S.C. 154(b) by 0 days.

(21) Appl. No.: 16/652,083

(22) PCT Filed: Oct. 10, 2017

(86) PCT No.: PCT/FI2017/050711
§ 371 (c)(1),
(2) Date: Mar. 30, 2020

(87) PCT Pub. No.: WO2019/073105
PCT Pub. Date: Apr. 18, 2019

(65) Prior Publication Data

US 2020/0271298 A1 Aug. 27, 2020

(51) Int. Cl.

| | |
|---|---|
| ***F21V 7/00*** | (2006.01) |
| ***F21V 5/04*** | (2006.01) |
| ***F21V 7/08*** | (2006.01) |
| ***F21V 13/04*** | (2006.01) |
| *F21Y 103/33* | (2016.01) |

(Continued)

(52) U.S. Cl.
CPC ..... *F21V 7/0041* (2013.01); *F21V 5/04* (2013.01); *F21V 7/0008* (2013.01); *F21V 7/08* (2013.01); *F21V 13/04* (2013.01); *F21W 2131/403* (2013.01); *F21Y 2103/33* (2016.08); *F21Y 2113/20* (2016.08)

(58) Field of Classification Search
CPC ..... F21V 7/0041; F21V 7/0008; F21V 7/08; F21V 7/04
See application file for complete search history.

(56) References Cited

U.S. PATENT DOCUMENTS

| | | | | |
|---|---|---|---|---|
| 2010/0053564 | A1* | 3/2010 | Itoh | G03B 21/28 353/37 |
| 2013/0077332 | A1* | 3/2013 | Hessling | F21V 13/02 362/470 |

(Continued)

FOREIGN PATENT DOCUMENTS

| | | |
|---|---|---|
| EP | 2295852 A2 | 3/2011 |
| EP | 2574837 A2 | 4/2013 |
| EP | 2924486 A1 | 9/2015 |

(Continued)

OTHER PUBLICATIONS

Japanese Office Action issued in corresponding Japanese Patent Application No. 2020-542200, dated Aug. 27, 2021, 5 pages (with English Translation).

*Primary Examiner* — Donald L Raleigh
(74) *Attorney, Agent, or Firm* — Merchant & Gould P.C.

(57) ABSTRACT

The invention relates to a working light with glare reduction. The working light comprising at least one light source, at least one primary reflector element, which further comprises a lower edge, a first focus on the optical vertical axis y above a horizontal axis x and a second focus on an optical vertical axis y below the horizontal axis x. Further, the working light according to the invention comprises at least one secondary reflector element further comprising a secondary focus.

14 Claims, 4 Drawing Sheets

(51) Int. Cl.
*F21Y 113/20* (2016.01)
*F21W 131/403* (2006.01)

(56) References Cited

U.S. PATENT DOCUMENTS

| | | | | |
|---|---|---|---|---|
| 2016/0186938 | A1* | 6/2016 | Liao | F21V 13/08 362/84 |
| 2017/0254497 | A1 | 9/2017 | Sun et al. | |

FOREIGN PATENT DOCUMENTS

| | | | |
|---|---|---|---|
| EP | 3165819 | A1 | 5/2017 |
| JP | 2002-109916 | A | 4/2002 |
| JP | 2006-127856 | A | 5/2006 |
| JP | 2013-49987 | A | 3/2013 |
| JP | 2003229006 | A | 8/2013 |
| WO | 2011/077947 | A | 6/2011 |

* cited by examiner

Flux=995lm; I max at(2.5,-25.9)=2890 cd

WORKING LIGHT

PRIORITY

This application is a U.S. national application of the international application number PCT/FI2017/050711 filed on Oct. 10, 2017, the contents of which is incorporated herein by reference.

TECHNICAL FIELD OF THE INVENTION

The invention relates to a working light with glare reduction.

BACKGROUND OF THE INVENTION

Various working lamps, working lights and light installations are known. A common problem with the known working lights relates to glare especially when the working lights are mounted high in comparison to the ground level.

For example, when a working light is mounted high on top of a working machine or working vehicle, a common problem is that persons walking or standing on the ground level suffer from the glare caused by the working lights on various distances even when the persons remain outside an effective working area of the working lights. This is caused by diffused light distribution. This impacts negatively to general work safety conditions and work ergonomics on various working environments requiring effective working lights such as construction sites and industrial sites and premises, for example.

The glare problem has been presented also in the automotive industry and the automotive field has certain standards and requirements in different countries regarding light distribution and glare of motor vehicles' lightning systems. However, the problem with the working lights is somewhat different than within the automotive industry as in comparison to motor vehicles' lights, the working lights in various conditions and installations are mounted high in relation to ground level or even persons walking or standing on the ground level.

Lightning systems in general may be understood to comprise an optical axis y that is vertical and a horizontal axis x. The standards and industry requirements within the automotive field allow some of the light distribution to extend above the horizontal axis x. For the working lights that are mounted high, the main light beam must remain below the horizontal axis x in order to avoid or to reduct glare.

Therefore, solutions known from the automotive industry can not be applied to the working lights. It becomes apparent that a working light solution that implements glare reduction is also needed.

SUMMARY OF THE INVENTION

The object of the present invention is to provide a working light with glare reduction.

Also, the object of the present invention is to provide a working light with glare reduction that may be applied with various working machines and working vehicles and on various industrial sites and conditions.

Further, the object of the present invention is to provide a working light with glare reduction where the light distribution remains below the horizontal axis x with zero tilt angle of the working light when the working light is mounted in high position and the effective working area is located below the horizontal axis x.

Moreover, the object of the present invention is to provide a working light with glare reduction that has high luminating efficiency.

Finally, the object of the present invention is to provide a working light with glare reduction that can be installed without tilting the light.

The objects of the present invention are fulfilled by providing a working light comprising at least one light source, an optical vertical axis y and a horizontal axis x wherein the optical axis y and the horizontal axis x intersect each perpendicularly, at least one primary reflector element further comprising a lower edge, a first focus above the horizontal axis x and a second focus below the horizontal axis x, at least one secondary reflector element further comprising a secondary focus, characterized in that the at least one light source is located on the first focus of the at least one primary reflector element, the at least one secondary reflector element is placed so that its secondary focus is located on the same point with the second focus of the at least one primary reflector element below the horizontal axis x, the at least one primary reflector element is arranged to reflect light beams emitting from the at least one light source via the second focus to the at least one secondary reflector element, the lower edge of the at least one primary reflector element is arranged to prevent the light beams emitting from the at least one light source to reach an area above the horizontal axis x, and that at least one secondary reflector element is arranged to form a light distribution for the light beams so that the most of the light remains below the horizontal axis x.

Some advantageous embodiments of the present invention are disclosed in dependent claims.

The basic idea of the invention is as follows: The working light according to the invention comprises at least one light source. Further, an optical vertical axis y and a horizontal axis x are defined for the working light according to invention. The optical axis y and the horizontal axis x intersect each perpendicularly. The working light according to the invention also comprises at least one primary reflector element, which further comprises a lower edge, a first focus on the optical vertical axis y above the horizontal axis x and a second focus on the optical vertical axis y below the horizontal axis x. Moreover, the working light according to the invention comprises at least one secondary reflector element further comprising a secondary focus.

Advantageously, according to one embodiment of the invention, the at least one light source is located on the first focus of the at least one primary reflector element or light emitting from the at least one light source is directed to the first focus of the at least one primary reflector element by at least one light guide element. Also advantageously, the at least one secondary reflector element is placed so that its secondary focus is located on the same point with the second focus of the at least one primary reflector element on the optical vertical axis y below the horizontal axis x. The effective working area is located below the horizontal axis x and area of the undesired glare is located above the horizontal axis x.

Further, the at least one primary reflector element reflects the light emitting from the at least one light source via the second focus to the at least one secondary reflector element. The lower edge of the at least one primary reflector element is arranged to prevent the light beams emitting from the at least one light source to reach an area above the horizontal axis x. The lower edge of the at least one primary reflector element prevents the direct light beams emitting from the at least one light source to reach an area above the horizontal axis x and the at least one secondary reflector element is arranged to form a light distribution for the light so that the most of the light remains below the horizontal axis x.

Advantageously, the at least one primary reflector element is essentially an ellipsoid or a freeform by its form. If the at least one primary reflector element is essentially a freeform, it should be noted that the focus may be defined as three dimensional space.

The at least one secondary reflector element is arranged to form a light distribution for the received light so that the most of the light remains below the horizontal axis x. The at least one secondary reflector element by its form is at least one of the following: paraboloid, ellipsoid hyperboloid or freeform. However, any other form fit for the purpose may be applied for the at least one secondary reflector element.

According to another advantageous embodiment of the invention, the working light further comprises at least one third reflector element. The at least one third reflector element is essentially an ellipsoid by its form. The at least one third reflector element further comprises a third focus one that is located above the horizontal axis x and a third focus two that is located above the horizontal axis x on the first focus of the at least one primary reflector element. The at least one third reflector element further comprises a third focus one that is located above the horizontal axis x and a third focus two that is located above the horizontal axis x on the first focus of the at least one primary reflector element in case when light emitting from the at least one light source is directed to the first focus of the at least one primary reflector element by the at least one light guide element.

According to a third advantageous embodiment of the invention, the working light may also be implemented by applying any of the previous embodiments vice versa. In that case, the light emitted directly from the at least one light source is directed to the at least one secondary reflector element. In such case, the at least one primary reflector element comprises a first focus on the optical vertical axis y below the horizontal axis x and a second focus on the optical vertical axis y above the horizontal axis x. The lower edge of the at least one primary reflector element is now actually an upper edge. The at least one light source is located on the first focus of the at least one primary reflector element or light emitting from the at least one light source is directed to the first focus of the at least one primary reflector element by at least one light guide element. The at least one secondary reflector element is placed so that its secondary focus is located on the same point with the second focus of the at least one primary reflector element on the optical vertical axis y above the horizontal axis x. Further, the at least one primary reflector element reflects the light emitting from the at least one light source via the second focus to the at least one secondary reflector element. The lower edge of the at least one primary reflector element extends below the horizontal axis x. The lower edge of the at least one primary reflector element prevents the light beams emitting from the at least one light source to reach an area below the horizontal axis x and at least one secondary reflector forms a light distribution for the light beams so that the most of the light beams remain above the horizontal axis x. Namely, the lower edge of the at least one primary reflector element prevents the direct light beams emitting from the at least one light source to reach an area below the horizontal axis x and at least one secondary reflector forms a light distribution for the light beams so that the most of the light beams remain above the horizontal axis x.

Further scope of applicability of the present invention will become apparent from the detailed description given hereafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and accompanying drawings which are given by way of illustration only, and thus are not limitative of the present invention and wherein.

DETAILED DESCRIPTION

In the following description, considered embodiments are merely exemplary, and one skilled in the art may find other ways to implement the invention. Although the specification may refer to "an", "one; or "some" embodiment(s) in several locations, this does not necessarily mean that each such reference is made to the same embodiment(s), or that the feature only applies to a single embodiment. Single feature of different embodiments may also be combined to provide other embodiments.

Figure 1:
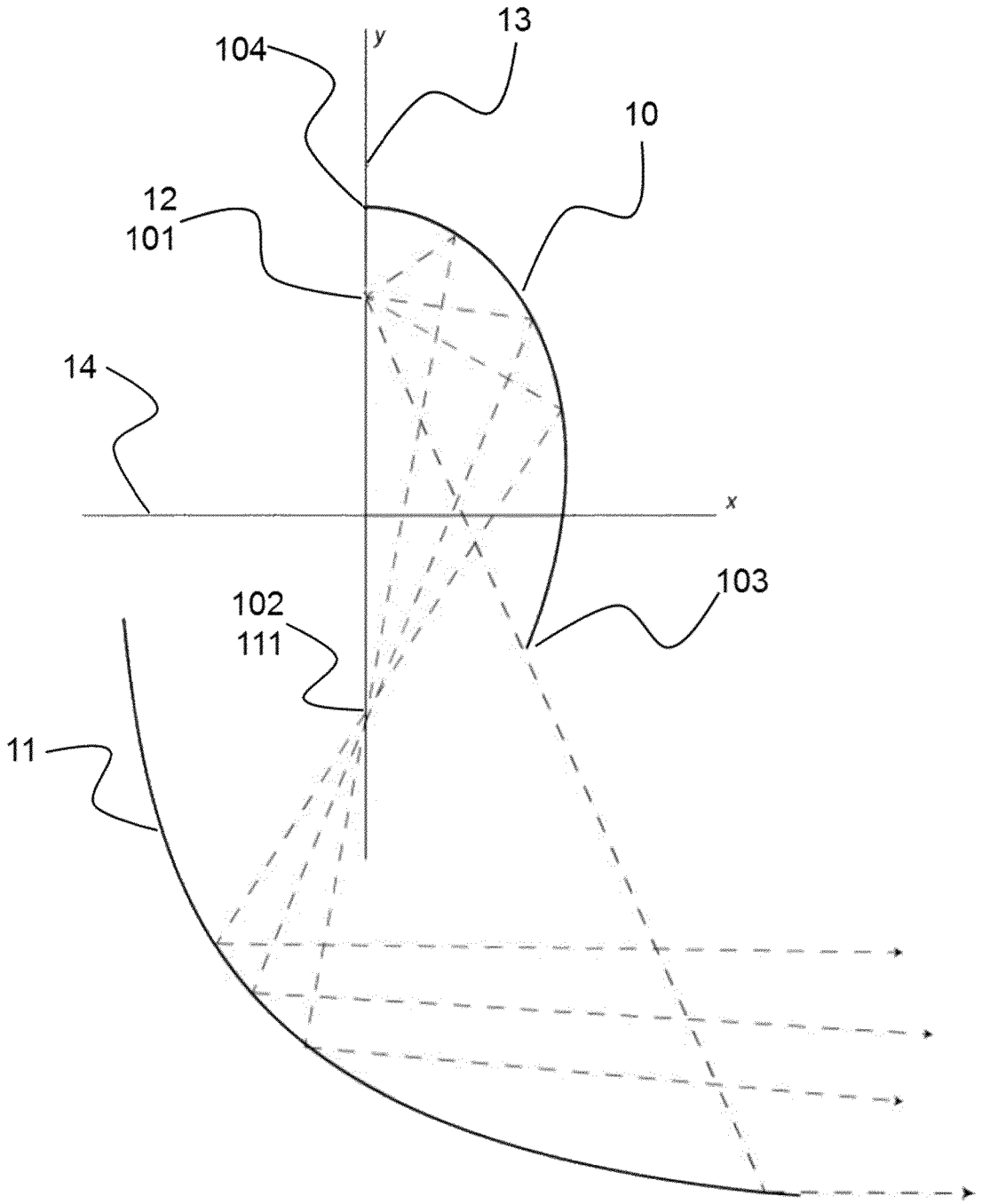
FIG. 1 shows an exemplary schematical representation of the working light according to the invention.

FIG. 1 shows an exemplary schematical representation of the working light according to the invention. The working light according to the invention comprises a frame to which various components and elements of the working light may be installed. The working light according to the invention comprises at least one light source 12, an optical vertical axis y 13 and a horizontal axis x 14 wherein the optical axis y 13 and the horizontal axis x 14 intersect each perpendicularly, at least one primary reflector element 10 and at least one secondary reflector element 11.

The at least one primary reflector element further comprises a lower edge 103, a first focus 101 on the optical vertical axis y 13 above the horizontal axis x 14 and a second focus 102 on the optical vertical axis y 13 below the horizontal axis x 14. The at least one secondary reflector element 11 further comprises a secondary focus 111. The at least one primary reflector element further comprises an upper edge 104. The first 101 and the second focus 102 are aligned to the optical vertical axis y 13 on a distance from each other. The first 101 and the second focus 102 are located on a distance from each other on the optical vertical axis y 13.

The at least one light source 12 is located on the first focus 101 of the at least one primary reflector element 10. Namely, the at least one light source 12 is located on the same point with the first focus 101 of the at least one primary reflector element 10 considering the location of the first focus 101 on the optical vertical axis y 13 above the horizontal axis x 14. The at least one light source 12 is aligned to the same point with the first focus 101 of the at least one primary reflector element 10 considering the location of the first focus 101 on the optical vertical axis y 13 above the horizontal axis x 14.

The at least one secondary reflector element 11 is placed so that its secondary focus 111 is located on the same point with the second focus 102 of the at least one primary reflector element 10 on the optical vertical axis y 13 below the horizontal axis x 14. Therefore, the location of secondary focus 111 the at least one secondary reflector element 11 equals to the location of the second focus 102 of the at least one primary reflector element 10.

The at least one primary reflector element 10 is arranged to reflect the light emitting from the at least one light source 12 via the second focus 102 to the at least one secondary reflector element 11. The at least one primary reflector element 10 is arranged to reflect light emitting from the at least one light source 12 via the first focus 101 and the second focus 102 to the at least one secondary reflector element 11. Moreover, the at least one primary reflector element 10 is arranged to reflect light emitting from the at least one light source 12 via the first focus 101 and the second focus 102 and the secondary focus 111 to the at least one secondary reflector element 11.

Advantageously, the lower edge 103 of the at least one primary reflector element 10 is arranged to prevent the light beams emitting from the at least one light source 12 to reach an area above the horizontal axis x 14. Namely, the lower edge 103 of the at least one primary reflector element 10 is arranged to prevent the direct light beams emitting from the at least one light source 12 to reach an area above the horizontal axis x 14. The lower edge 103 of the at least one primary reflector element 10 may extend below the horizontal axis x 14. The lower edge 103 of the at least one primary reflector element 10 is arranged to extend below the horizontal axis x 14 in order to prevent the direct light beams emitting from the at least one light source 12 to reach an area above the horizontal axis x 14. Moreover, the second focus 102 of the at least one secondary reflector element 11 and the secondary focus 111 bundle the light beams emitting from the at least one light source 12 to the at least one secondary reflector element 11 and the lower edge 103 of the at least one primary reflector element 10 prevents the direct light beams emitting from the at least one light source 12 to reach an area above the horizontal axis x 14. Therefore, all of the light emitting from the at least one light source 12 remain below the horizontal axis x 14.

Also advantageously, the at least one secondary reflector element 11 is arranged to be at least one of the following: paraboloid, ellipsoid, hyperboloid or freeform. The at least one secondary reflector element 11 is arranged to form a light distribution for the light so that the most of the light remains below the horizontal axis x 14. The at least one secondary reflector element 11 is arranged to form a light distribution for the light reflected to it by the at least one primary reflector element 10 in a manner that the most of the light beam remains below the horizontal axis x 14. The at least one secondary reflector element 11 is arranged to form a light distribution for the light reflected to it by the at least one primary reflector element 10 in a manner that the most of the light beam remains below the horizontal axis x 14 as presented in FIGS. 3*a* and 3*b*.

Figure 2:
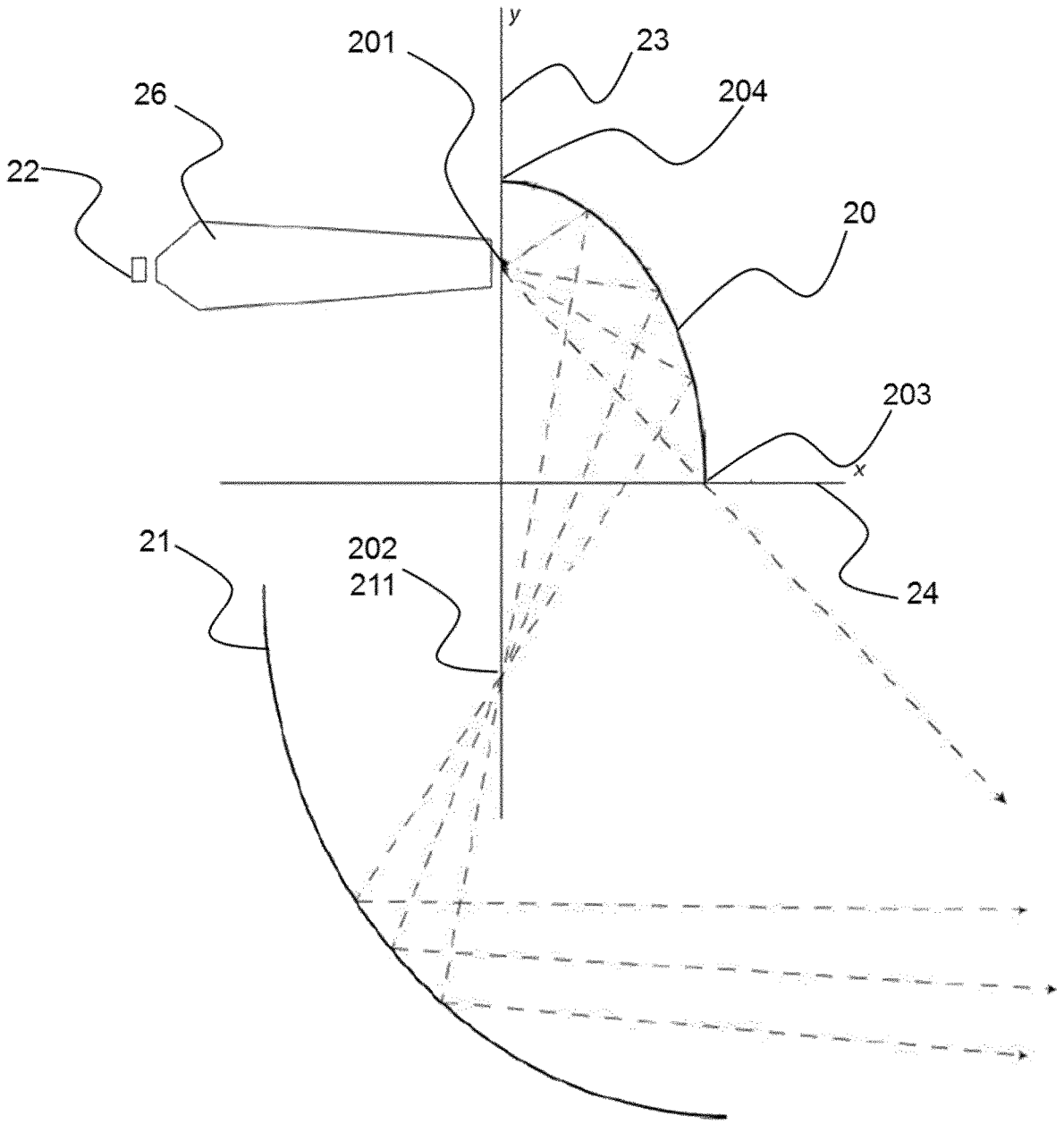
FIG. 2 shows a second exemplary schematical representation of the working light according to the invention.

FIG. 2 shows another exemplary schematical representation of the working light according to the invention. The working light according to the invention comprises at least one light source 22, an optical vertical axis y 23 and a horizontal axis x 24 wherein the optical axis y 23 and the horizontal axis x 24 intersect each perpendicularly, at least one primary reflector element 20 and at least one secondary reflector element 21.

The at least one primary reflector element 20 further comprises a lower edge 203, a first focus 201 on the optical vertical axis y 23 above the horizontal axis x 24 and a second focus 202 on the optical vertical axis y 23 below the horizontal axis x 24. The at least one secondary reflector element 21 further comprises a secondary focus 211. The first 201 and the second focus 202 are located on a distance from each other on the optical vertical axis y 23. The first 201 and the second focus 202 are aligned to the optical vertical axis y 23 on a distance from each other on.

The light emitting from the at least one light source 22 is directed to the first focus of the at least one primary reflector element by at least one light guide element 26. The at least one light source 22 is located separately from the first focus 201 of the at least one primary reflector element 10. The at least one light guide element 26 guides the light emitting from the at least one light source 22 via first focus 201 to the at least one primary reflector element 20.

The at least one secondary reflector element 21 is placed so that its secondary focus 211 is located on the same point with the second focus 202 of the at least one primary reflector element 20 on the optical vertical axis y 23 below the horizontal axis x 24. Therefore, the location of secondary focus 211 the at least one secondary reflector element 21 equals to the location of the second focus 202 of the at least one primary reflector element 20.

The at least one primary reflector element 20 is arranged to reflect light emitting from the at least one light source 22 via the second focus 202 to the at least one secondary reflector element 21. The at least one primary reflector element 20 is arranged to reflect light emitting from the at least one light source 22 via the first focus 211 and the second focus 102 to the at least one secondary reflector element 21.

Advantageously, the lower edge 203 of the at least one primary reflector element 20 is arranged to prevent the light beams emitting from the at least one light source 22 to reach an area above the horizontal axis x 24. The lower edge 203 of the at least one primary reflector element 20 is arranged to prevent the direct light beams emitting from the at least one light source 22 to reach an area above the horizontal axis x 24. The lower edge 203 of the at least one primary reflector element 20 may extend below the horizontal axis x 24. The lower edge 203 of the at least one primary reflector element 20 may extend below the horizontal axis x 24 in order to prevent the direct light beams emitting from the at least one light source 22 to reach an area above the horizontal axis x 24. The at least one primary reflector element 20 may also comprise an upper edge 204.

Moreover, the first focus 201 of the at least one first reflector element 20 bundles the light emitting from the at least one light source 22 via the light guide element 26 and then directs the light via the at least one secondary reflector element 21 to the second focus 202 of the at least one secondary reflector element 21 and the secondary focus 211. The second focus 202 of the at least one secondary reflector element 21 and the secondary focus 211 bundle the light beams emitting from the at least one light source 22 to the at least one secondary reflector element 21 and the lower edge 203 of the at least one primary reflector element 20 prevents the direct light beams emitting from the at least one light source 22 to reach an area above the horizontal axis x 24. Therefore, all of the light emitting from the at least one light source 22 remain below the horizontal axis x 24.

Also advantageously, the at least one secondary reflector element 21 is arranged to be at least one of the following: paraboloid, ellipsoid, hyperboloid or freeform. The at least one secondary reflector element 21 is arranged to form a light distribution for the light so that the most of the light remains below the horizontal axis x 24. The at least one secondary reflector element 21 is arranged to form a light distribution for the light reflected to it by the at least one primary reflector element 20 in a manner that the most of the light remains below the horizontal axis x 24. The at least one secondary reflector element 21 is arranged to form a light distribution for the light reflected to it by the at least one primary reflector element 20 in a manner that the most of the light remains below the horizontal axis x 24 as presented in FIGS. 3*a* and 3*b*.

Figure 3A:
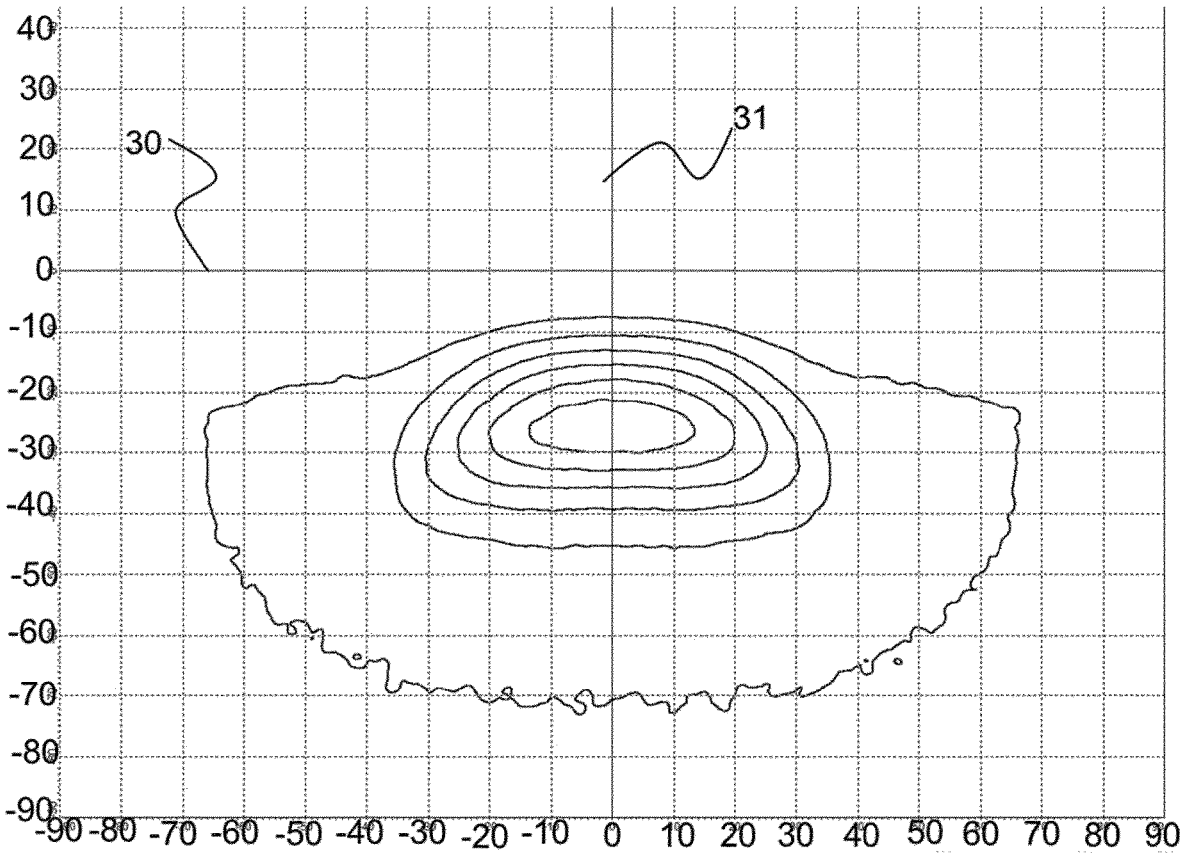
FIG. 3*a* shows an exemplary light distribution of the working light according to the invention.
Figure 3B:
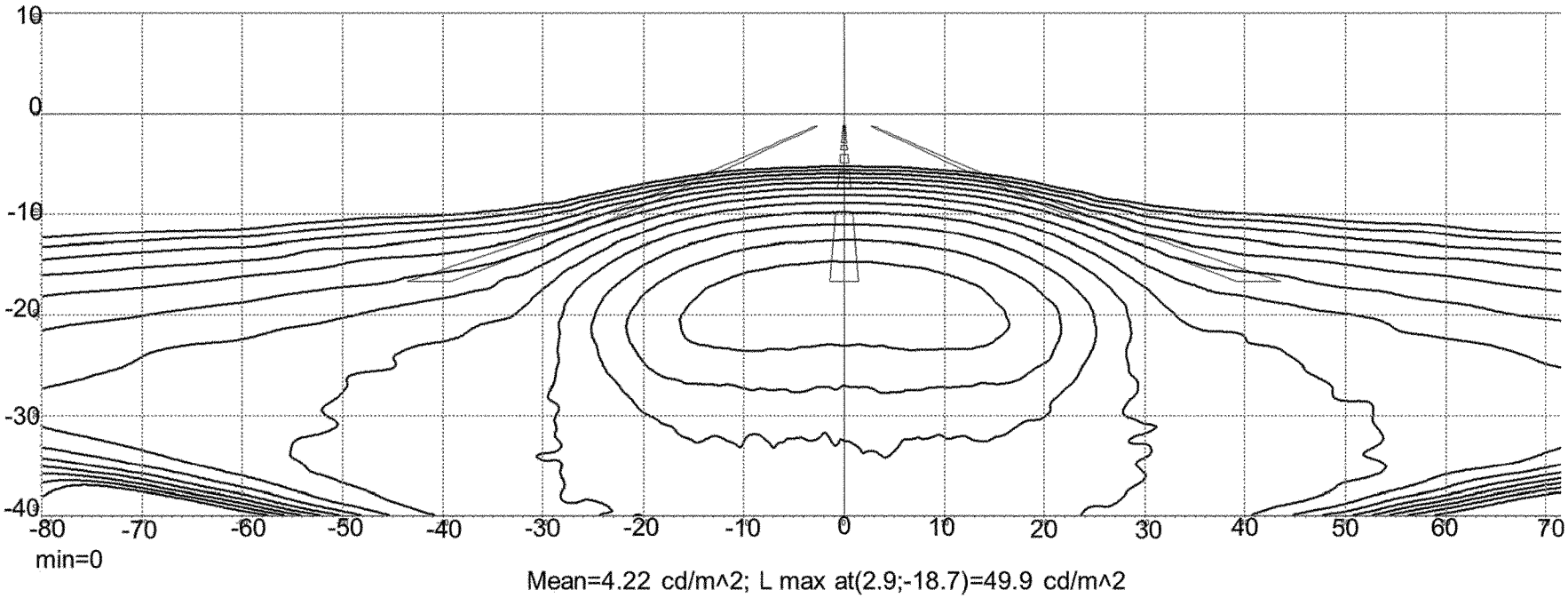
FIG. 3*b* shows also an exemplary light distribution of the working light according to the invention.

FIGS. 3*a* and 3*b* present exemplary light distribution formed by a working light according to the invention. The presentations are given within an angle space. FIG. 3*b* presents the light distribution projected to the ground level.

It can be seen from the FIG. 3*a* that the light distribution is vertically flat (in comparison to vertical axis y 31), spreads horizontally and remains below the horizontal axis x 30. The effective working area is located below the horizontal axis x. The same can be seen from FIG. 3*b* whereas the light distribution remains vertically flat and is directed to towards the ground level and spreads horizontally. In case of FIG. 3*b* the working light is mounted in the height of two meters, the person facing the light has his/her eyes on in the height of 1.7 meters and the working light has not been tilted (zero tilt angle). Persons outside the effective working area are not affected by the glare.

Some advantageous embodiments according to the invention were described above. The invention is not limited to the embodiments described. The inventional idea can be applied in numerous ways within the scope defined by the claims attached hereto.

The invention claimed is:

1. A working light comprising:

one light source;

an optical vertical axis and a horizontal axis, wherein the optical vertical axis and the horizontal axis intersect each other perpendicularly;

at least one primary reflector element comprising an ellipsoid profile, a lower edge, a first focus above the horizontal axis and a second focus below the horizontal axis;

at least one secondary reflector element comprising an ellipsoid profile and a secondary focus, wherein the light source is located on the first focus of the at least one primary reflector element;

the at least one secondary reflector element is placed so that the secondary focus is located on the the second focus of the at least one primary reflector element below the horizontal axis;

the at least one primary reflector element is arranged to reflect light beams emitting from the one light source via the second focus to the at least one secondary reflector element;

the lower edge of the at least one primary reflector element is arranged as a barrier intermediate the light beams emitting from the one light source and an area above the horizontal axis; and at least one of the at least one secondary reflector element is arranged to form a light distribution for the light beams so that a majority of the light beams remain below the horizontal axis.

2. The working light according to claim 1, wherein the lower edge of the at least one primary reflector element projects downward and toward the optical vertical axis.

3. The working light according to claim 1, wherein a lower edge of the at least one secondary reflector element projects downward and away from the optical vertical axis.

4. The working light according to claim 1, wherein the lower edge of the at least one primary reflector element is arranged to extend below the horizontal axis.

5. The working light according to claim 1, wherein the lower edge of the at least one primary reflector element is in a blocking arrangement intermediate direct light beams emitting from the at least one light source and an area above the horizontal axis.

6. The working light according to claim 1, wherein light from the light source is directed to the first focus of the at least one primary reflector by at least one light guide element.

7. The working light according to claim 1, wherein the optical vertical axis extends through a portion of the at least one secondary reflector element.

8. The working light according to claim 1, wherein an upper edge of the at least one secondary reflector element is higher than the lower edge of the at least one primary reflector element.

9. The working light according to claim 1, wherein the at least one secondary reflector element extends through and horizontally beyond the optical vertical axis.

10. The working light according to claim 1, wherein the at least one secondary reflector element extends under the optical vertical axis, and under and horizontally beyond the at least one primary reflector element.

11. The working light according to claim 1, wherein the lower edge of the primary reflector element is below the horizontal axis.

12. The working light according to claim 1, wherein the at least one secondary reflector element comprises an upward arcing upper surface.

13. A working light comprising:

a single light source;

a primary reflector element having an ellipsoid profile, a lower edge, a first focus on an optical vertical axis and a second focus on the optical vertical axis, wherein the first focus is above the second focus and a horizontal axis defined between the first focus and the second focus and crossing the optical vertical axis perpendicularly; and a secondary reflector element having an ellipsoid profile and a secondary focus, and being located so that the secondary focus is located on the second focus of the primary reflector element on the optical vertical axis below the horizontal axis;

wherein:

the single light source is located on the first focus of the primary reflector element on the optical vertical axis above the horizontal axis; and the primary reflector element is arranged to reflect light beams emitting from the single light source via the second focus to the secondary reflector element;

the lower edge of the primary reflector element is in a blocking arrangement intermediate the light beams emitting from the single light source and an area above the horizontal axis; and the secondary reflector element is arranged to form a light distribution for the light beams so that a majority of the light beams remain below the horizontal axis.

14. A working light comprising:

a single light source;

a primary reflector element having an ellipsoid profile, a lower edge, a first focus on an optical vertical axis and a second focus on the optical vertical axis, wherein the first focus is above the second focus and a horizontal axis defined between the first focus and the second focus and crossing the optical vertical axis perpendicularly; and a secondary reflector element having an ellipsoid profile and a secondary focus, and being located so that the secondary focus is located on the second focus of the primary reflector element on the optical vertical axis below the horizontal axis;

wherein:

the single light source is located on the first focus of the primary reflector element on the optical vertical axis above the horizontal axis; and the primary reflector element is arranged to reflect light beams emitting from the single light source via the second focus to the secondary reflector element;

the lower edge of the primary reflector element is in a blocking arrangement intermediate the light beams emitting from the single light source and an area above the horizontal axis; and the secondary reflector element is arranged to form a light distribution for the light beams so that the light beams remain below the horizontal axis;

the optical vertical axis extends through a portion of the secondary reflector element and the secondary reflector element extends horizontally beyond the optical vertical axis.

* * * * *